US006688936B2

(12) United States Patent
Davis

(10) Patent No.: US 6,688,936 B2
(45) Date of Patent: Feb. 10, 2004

(54) ROTATING TOY WITH DIRECTIONAL VECTOR CONTROL

(76) Inventor: Steven Davis, Suite 701-3 Wing On Plaza 62 Mody Road, TST East, Hong Kong (HK)

( * ) Notice: Subject to any disclaimer, the term of this patent is extended or adjusted under 35 U.S.C. 154(b) by 142 days.

(21) Appl. No.: 09/819,189

(22) Filed: Mar. 28, 2001

(65) Prior Publication Data

US 2002/0142699 A1 Oct. 3, 2002

(51) Int. Cl.[7] ..... A63H 27/127
(52) U.S. Cl. ..... 446/37; 446/175; 446/456
(58) Field of Search ..... 446/37, 175, 454, 446/456

(56) References Cited

U.S. PATENT DOCUMENTS

| | | | | | |
|---|---|---|---|---|---|
| 3,549,109 | A | | 12/1970 | Gilstrap | |
| 3,568,358 | A | * | 3/1971 | Bruce | 446/37 |
| 3,727,055 | A | | 4/1973 | David et al. | |
| 4,452,174 | A | * | 6/1984 | Fedder | 222/57 |
| 4,828,525 | A | | 5/1989 | Okano | |
| 4,923,303 | A | | 5/1990 | Lutz | |
| 4,931,028 | A | | 6/1990 | Jaeger et al. | |
| 4,995,722 | A | | 2/1991 | Sutour | |
| 5,071,383 | A | * | 12/1991 | Kinoshita | 446/37 |
| 5,297,759 | A | | 3/1994 | Tilbor et al. | |
| 5,407,151 | A | | 4/1995 | Singhal | |
| 5,429,542 | A | | 7/1995 | Britt, Jr. | |
| 5,452,901 | A | | 9/1995 | Nakada et al. | |
| 5,634,839 | A | | 6/1997 | Dixon | |
| 5,672,086 | A | | 9/1997 | Dixon | |
| 5,723,928 | A | * | 3/1998 | Imai et al. | 310/114 |
| 5,971,320 | A | | 10/1999 | Jermyn et al. | |
| 6,389,329 | B1 | * | 5/2002 | Colens | 700/262 |

FOREIGN PATENT DOCUMENTS

| | | | | |
|---|---|---|---|---|
| JP | 01201294 A | * | 8/1989 | A63H/27/127 |
| JP | 03289984 A | * | 12/1991 | A63H/27/127 |
| WO | WO 99/10235 | | 3/1999 | |
| WO | WO 200187446 A1 | * | 11/2001 | A63H/27/127 |

* cited by examiner

*Primary Examiner*—Derris H. Banks
*Assistant Examiner*—Urszula M Cegielnik

(57) ABSTRACT

The rotating toy in accordance with the present invention includes a hub having an outer portion rotatably connected to an inner portion. At least three rods extending outwardly from the hub to connect to an outer ring. A motor operably connected to a propeller is further disposed on each rob between the hub and the outer ring. In addition the rods are positioned such that each is offset by the same predetermined angle. When operating, the propellers spin in a first direction exerting a reaction torque in the opposite direction causing the outer portion to rotate in the opposite direction. The inner portion includes a plurality of legs with vanes that protruded outwardly such that the downward moving air is deflected causing the inner portion not to rotate. A tether attached to a control box and the rotating toy communicates a drive voltage to each motor. The control box further includes a means for determining the orientation of the motors at a specified point of reference thereby permitting a user to change the direction of the rotating toy in reference to person operating the toy.

23 Claims, 10 Drawing Sheets

ROTATING TOY WITH DIRECTIONAL VECTOR CONTROL

FIELD OF THE INVENTION

This invention relates generally to toys and more particularly to rotating toys with directional controls.

BACKGROUND OF THE INVENTION

Most vertical takeoff and landing aircraft rely on gyro stabilization systems to remain stable in hovering flight. For instance, applicant's previous U.S. Pat. No. 5,971,320 and International PCT application WO 99/10235 discloses a helicopter with a gyroscopic rotor assembly. The helicopter disclosed therein further uses a yaw propeller mounted on the frame of the body to control the orientation or yaw of the helicopter. However, different characteristics are present when the body of the toy, such as a flying saucer model, rotates. First, gyro stabilization systems may not be necessary when the body rotates, for example, see U.S. Pat. Nos. 5,297,759 to Tilbor et al.; 5,634,839 and 5,672,086 to Dixon; and 5,971,320 to Jeymyn et al.

Second, when the entire toy rotates the toy loses an orientation reference in which directional control inputs from a remote position can be received and translated into actual directional movement of the saucer. In a helicopter, airplane, or "aircraft", the aircraft itself predetermines a specific orientation defined in the nose of the aircraft. In such circumstances a user pushing a joystick controller forwards (or pushing a forwards button) directs the aircraft to travel forwards from its point of reference, similar directional controls are found in conventional remote controlled vehicles. However, when a aircraft completely rotates such as a flying saucer or any other rotating toy, the toy loses its orientation as soon as it begins to spin, making directional control difficult to implement. For example, U.S. Pat. No. 5,429,542 to Britt, Jr. as well as U.S. Pat. No. 5,297,759 to Tilbor et al. disclose rotary models or aircrafts but only address movement in an upwards, downwards or spinning direction; and U.S. Pat. Nos. 5,634,839 and 5,672,086 to Dixon discuss the use of a control signal to direct the rotating aircraft towards or away from the user, thus requiring the user to move about the rotating aircraft to the left or right if the user wants the saucer to move towards that particular direction. Implementing such directional controlling schemes in a closed environment such as a house makes controlling the aircraft extremely difficult.

In addition flying saucer models that entirely rotate prevent the rotating toy to have landing gear. For example, U.S. Pat. Nos. 5,297,759 to Tilbor et al.; 5,634,839 and 5,672,086 to Dixon; and 5,429,542 to Britt, Jr. do not include landing gear and as such must land directly on the bottom portion of the rotating aircraft. While it is plausible to have a landing gear on a toy on a helicopter, such as disclosed in U.S. Pat. No. 5,971,320 to Jermyn et al., the entire body of the helicopter does not rotate only the propeller portion rotates.

A need therefore exists to provide a rotating toy, preferably a rotating flying model that includes the means to achieve complete directional control from the perspective of the user. A need also exists to provide a means to land the rotating flying toy on a landing gear that is attached to a substantially non-rotating portion without have to stop the rotating of the toy.

SUMMARY OF THE INVENTION

In accordance with the present invention a rotating toy is provided and includes a hub defined by an outer portion rotatably connected by a substantially frictionless bearing to an inner portion. Extending outwardly from the outer portion is at least three rods offset from each other by a predetermined angle. Connected to the ends of the three rods is an outer ring and disposed on each rod between the hub and the outer ring is a rotary device, which includes a motor and propeller. When operating, the propellers rotate displacing air to generate lift and cause a reaction torque rotating the outer portion, rods, motors and outer ring. In addition, a plurality of legs extends downwardly from the inner portion of the hub in order to support the rotating toy, when the toy is on a surface. Each leg includes a vane protruding outwardly into the downwardly displaced air such that the vanes tend to drive the inner portion of the hub in a direction opposite of the outer portion. This causes the inner portion to be substantially non-rotating. The rotating toy further includes a means for determining a directional point of reference for the motors when the toy is rotating and includes a means for individually controlling the speed of the motors such that the rotating toy may travel in a specified direction. The rotating toy includes a tether that attaches a control box to the non-rotating portion of the rotating toy.

The toy also includes a means to remotely supply a drive voltage through the tether to each motor. The drive voltage is controlled through a throttle controller on the control box, and the amount of the drive voltage or amplitude of the drive voltage is applied uniformly to each motor, such that the propellers on each motor will rotate at the same rate. This will in turn permit the saucer to raise or lower substantially in a constant horizontal plane, meaning at a level plane and not tilted to one side. A cyclic or directional controller also on the control box controls the direction in which the saucer will travel, forwards, backwards, left or right. By adding a separate and predetermined sinusoidal wave to the drive voltage of each motor the resultant thrust vector of the saucer can be adjusted, causing the saucer to travel in a specified direction. In addition, the amplitude of the sinusoidal waves can be adjusted to correspond to the amount of movement in the directional controls, allowing the user to control the rate in which the saucer moves in that direction.

In another aspect of the present invention, the tether is attached through a feedback system that determines whether the toy is flying away from a center position. The feedback system sends a signal to a microprocessor that adjusts the amplitude and the beginning phase angle such that the rotating toy will substantially return to its center position.

In yet another aspect of the present invention, the adjustment of amplitude and the beginning phase angle may be incorporated in other rotating toys, such as ground-based toys using wireless means to communicate the adjustments.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENT

Figure 1:
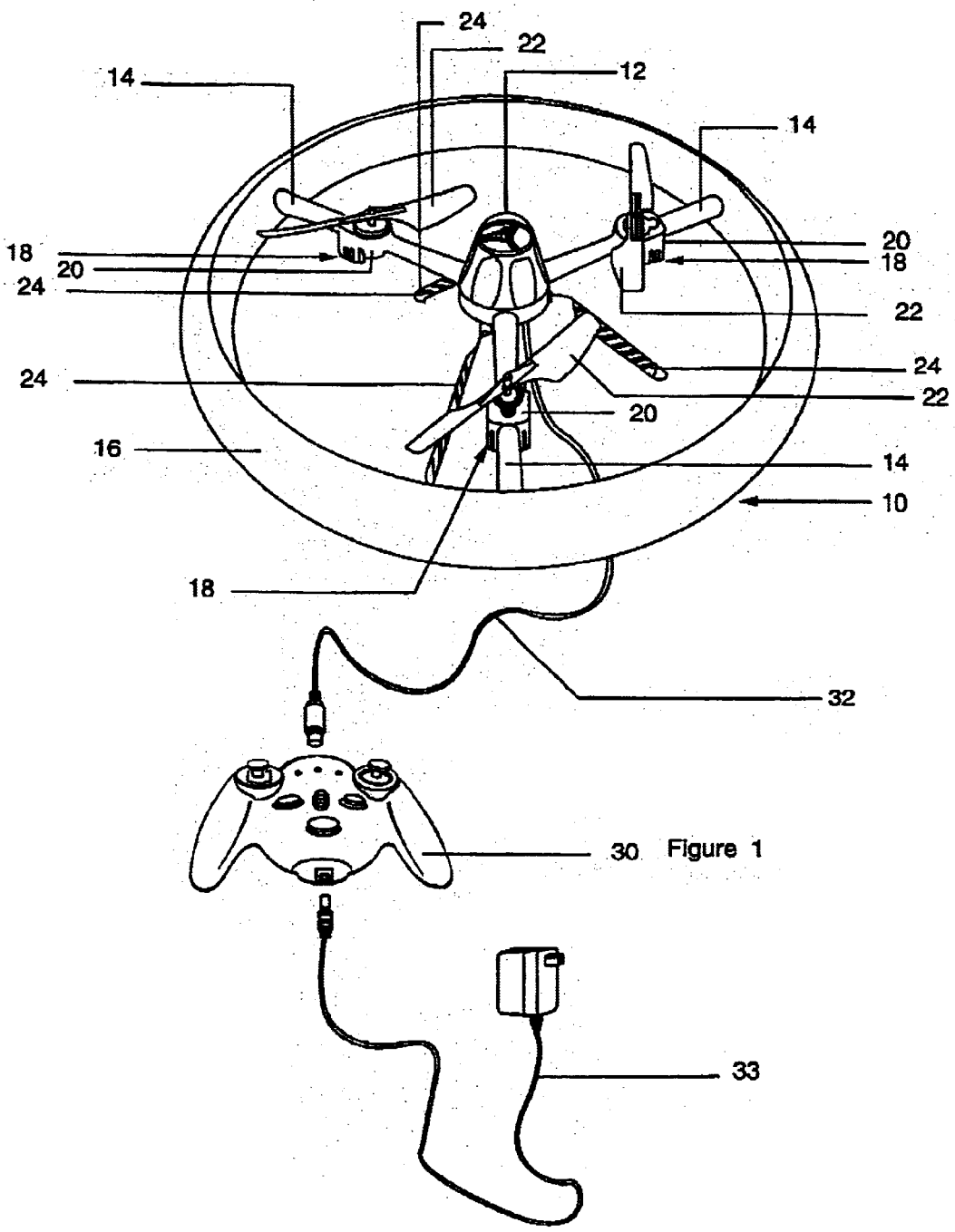
FIG. 1 is a perspective view of a flying rotating toy in accordance with the preferred embodiment of the present invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Referring first to FIG. 1, a rotating toy in accordance with the present invention is shown as a flying saucer embodiment and is generally referenced to as 10. The saucer 10 includes a hub 12 that supports at least three rods 14, which substantially extend outwardly from the hub 12 for a predetermined distance along the same plane. The rods 14 connect to and support an outer ring 16. The outer ring 16 is preferably made from a soft foam, to protect the propellers and provide a bumper if the saucer 10 were to hit an object, such as a wall. The outer ring 16 also provides additional mass far from the center of rotation increasing the stability by increasing the gyroscope effect.

Positioned on each rod 14, approximately in the center between the hub 12 and the outer ring 16, is a rotary device 18 that includes a motor 20 operably connected to a control means (discussed in greater detail below) by various wiring that may be contained and hidden within the rods 14. Coupled to each motor 20 is a propeller 22 inclined by approximately 4°, such that when the rotary devices 18 are operating, the rotating propellers 22 cause the saucer 10 to rotate in the opposite direction of the rotation of the propellers. Moreover, the motors 20 are also rotating the propellers 22 at such a rate that the saucer 10 may rotate extremely fast, approximately 300 revolutions per minute. The reaction torque from the three motors 20 may also assist with the rotation of the saucer 10, since the motors 20 all rotate in the same direction, as viewed from above. In addition, the propeller inclination may not be necessary when the aerodynamic resistance to rotation is low enough that the motor torque is all that becomes required to rotate the saucer 10.

As explained in greater detail below, a control box 30 controls the flight direction of the saucer 10. A tether 32 physically and operably connects the control box 30 through the hub 12 to the rotary devices 18, such that the user may control the direction and throttle of the saucer 10. In addition, rather then placing a power supply on the saucer 10 and to decrease the weight of the saucer 10, a wall plug 33 may be used to supply power to the motors 20. The wall plug 33 connects to the control box 30 and into a typical wall outlet. The tether 32 may then transfer power to the motors 20 as well as the IR emitters 50 and 52. The tether 32 is further attached to an inner portion 34 of the hub 12 (shown in FIG. 2). The inner portion 34 is attached to an outer portion 36 through a substantially frictionless bearing 38. As such when operating, the outer portion 36 rotates defining a rotating portion that includes the outer portion 36, the rods 14, the rotary devices 18 and the outer ring 16. Moreover, the inner portion 34, which is attached to the tether 32, defines a non-rotating portion.

The motors 20 may also be gas powered or powered by other means located on the saucer 10, and may include other means for propulsion rather than propellers. For example, the motors 20 may include exhaust nozzles that are angled to provide both lift and rotation or that may be variably angled such that the angle may be controlled or changed to alternate the direction of rotation. Such aspects may have further scope in other aeronautical or astronautical environments. In addition thereto, the embodiments described herein may be made to other rotary aircraft such as helicopters and scale-sized models or alternatively full sized rotary aircraft.

Continuing to refer to FIG. 1, the hub 12 may also include at least three legs 24 that extend downwardly and outwardly from the non-rotating portion or inner portion 34 of the saucer 10. The legs 24 support the saucer 10 both while it is resting on the ground or a flat surface prior to takeoff and during landing. Each leg 24 also includes a vane 26 protruding outwardly along the length of the leg and inclined approximately 45° into the airflow from the three propellers 18. As the air is deflected off the vanes a "vane force" is created that tends to drive the non-rotating portion in the opposite direction of the rotation of the saucer 10. The angle of these vanes 26 are such that the vane force cancels the rotational force created by any friction between the non-rotating portion and the rotating portion.

Figure 2:
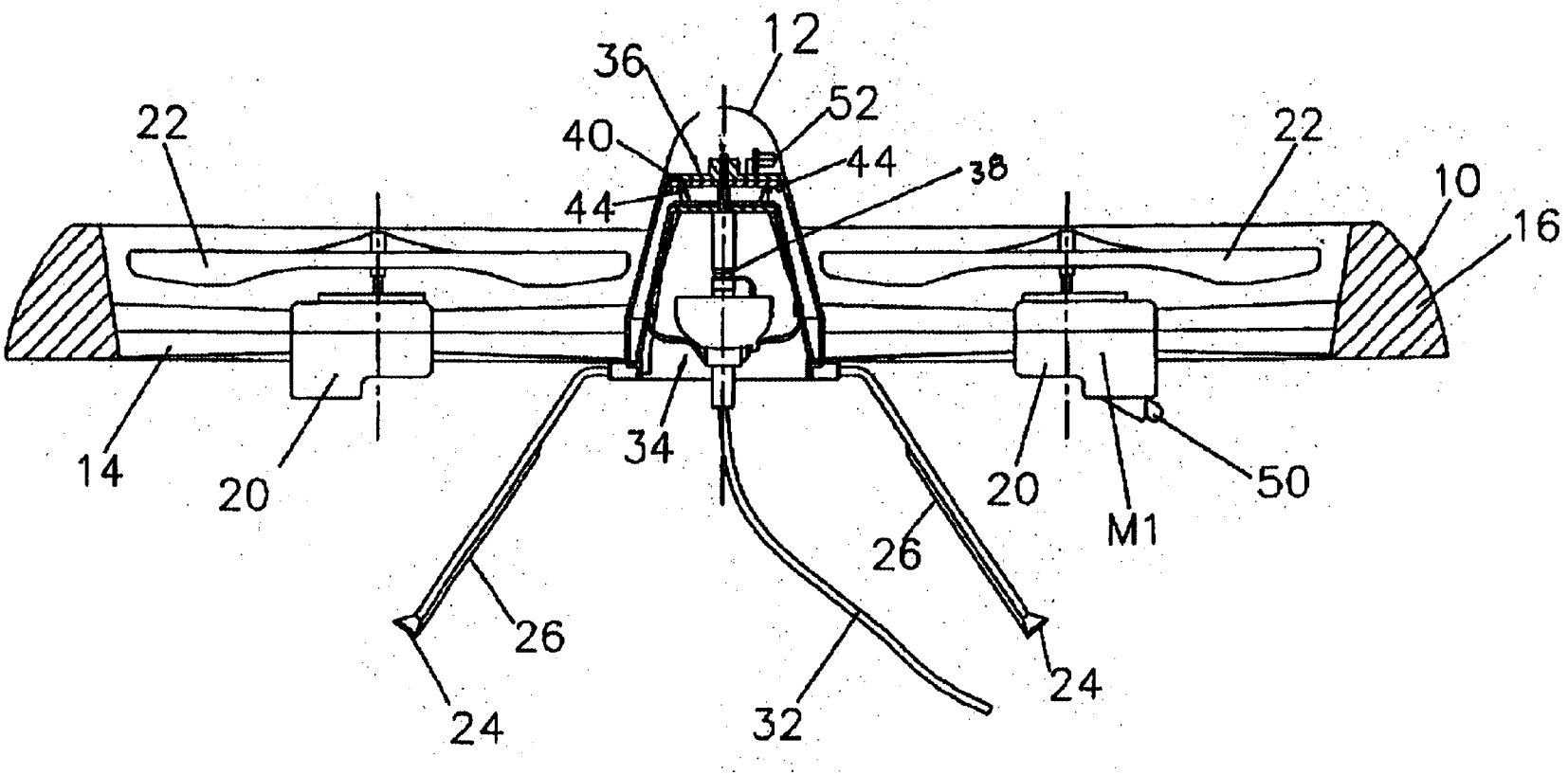
FIG. 2 is a side sectional view of FIG. 1, illustrating the connection between the non-rotating and rotating portions of the saucer and the position of the IR emitters.
Figure 3:
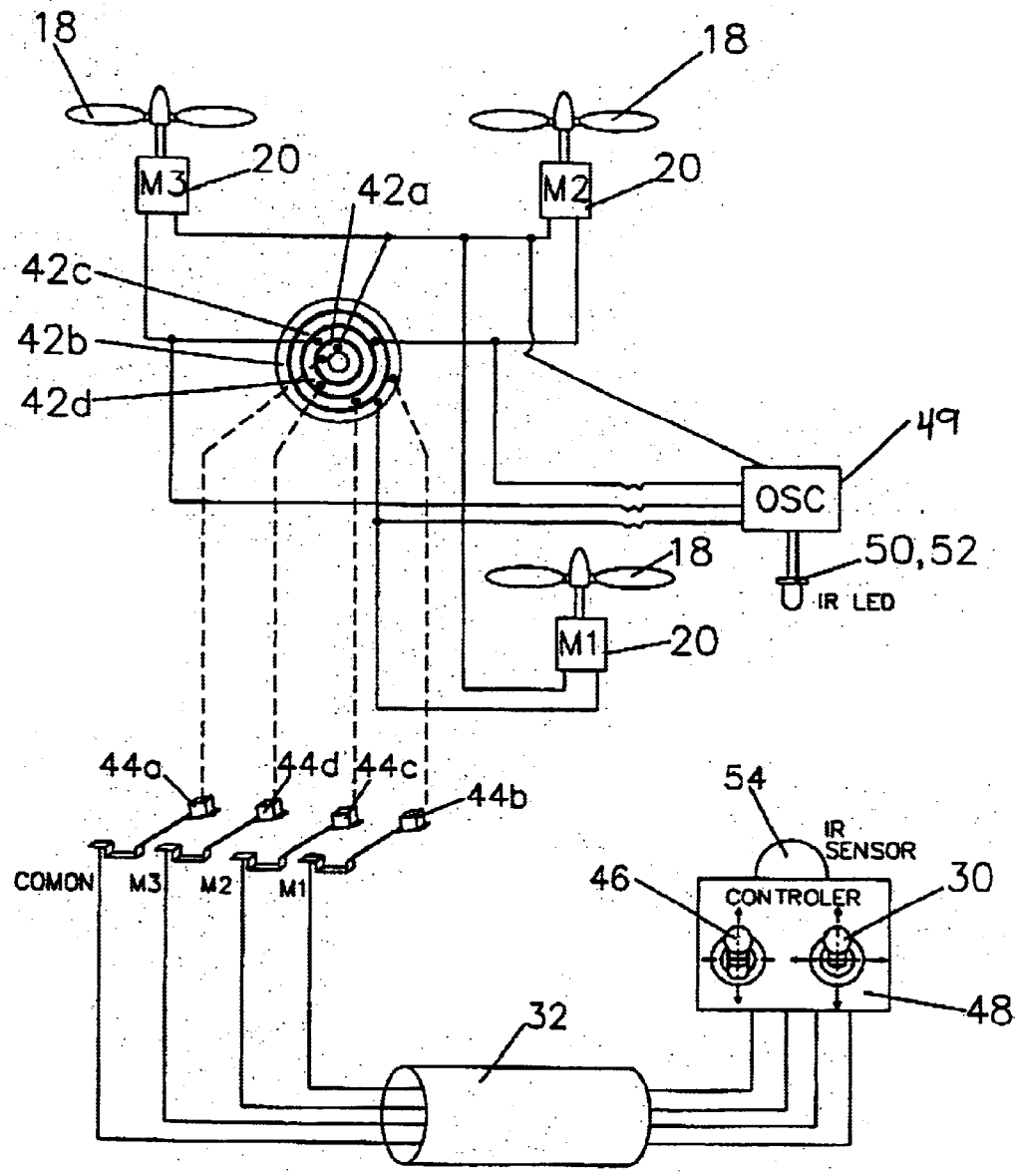
FIG. 3 is a schematic drawing of the connection between the control box and the three motors.

Since the tether 32 is connected to the non-rotating portion, the direction and throttle inputs as well as power must be communicated from the non-rotating portion to the rotating portion, especially to the rotary devices 18. Referring now to FIGS. 2 and 3, in one embodiment, a small circuit board 40 with four rings (42*a*, 42*b*, 42*c* and 42*d*, respectively; and generally numerated as 42, shown in FIG. 3) is attached to the outer portion 36 of the hub 12, which come into contact with corresponding spring loaded carbon brushes (44*a*, 44*b*, 44*c* and 44*d*; and generally numerated as 44) mounted on the inner portion 34. The center ring 42*a* is common to allow the circuits to close upon contact by the other brushes 44*b*, 44*c* and 44*d* with their corresponding rings 42*b*, 42*c* and 42*d*. The three rings 42*b*, 42*c* and 42*d* also individually correspond to one of the motors 20 on each rotary device 18, M1, M2 and M3 respectively. It is further important to note that other means may be employed to achieve the objective of communicating the control inputs from the control box 30 to the rotary devices 18.

The control box 30 further includes either joysticks or buttons that feed throttle and directional control signals through the circuit board 40 to control the rotary devices 18. As illustrated, the control box 30 includes a throttle joystick 46 and a cyclic or directional joystick 48.

In addition thereto, the power received through the brushes 44 and corresponding rings 42 may be used to power the IR emitters 50 and 52 as well as a plurality of LEDs or other light transmitters that may be positioned about the saucer 10 for various lighting effects.

As mentioned above, when the saucer 10 begins to rotate it loses its point of reference or orientation such that the saucer 10 has no internal means of determining direction. To provide the saucer with a reference point relative to the user, IR emitters 50 and 52 are mounted, in the same radial axis, on the saucer 10 (shown in FIG. 2). The first IR emitter 50 is mounted on the lower portion under one of the motors 20 included downwardly at about 40° and the second IR emitter 52 is mounted on the top portion of the hub 12 inclined upwardly at about a 20° angle. As such the IR emitters 50 and 52 cast their beam on the same radial axis but at two different elevations, providing coverage for most of the saucer's 10 range of travel above and below the control box 30. The IR beam is received by an IR receiver or IR sensor 54 positioned on the front end of the control box 30.

The IR emitters are modulated by a fixed frequency by circuitry, such as an oscillator 49, shown in FIG. 3. This will aid in distinguishing the IR beam from ambient light that may include some IR components. This also allows several saucers 10 to fly in the same space without interfering with each other by using a different modulated frequency for each saucer.

Figure 4:
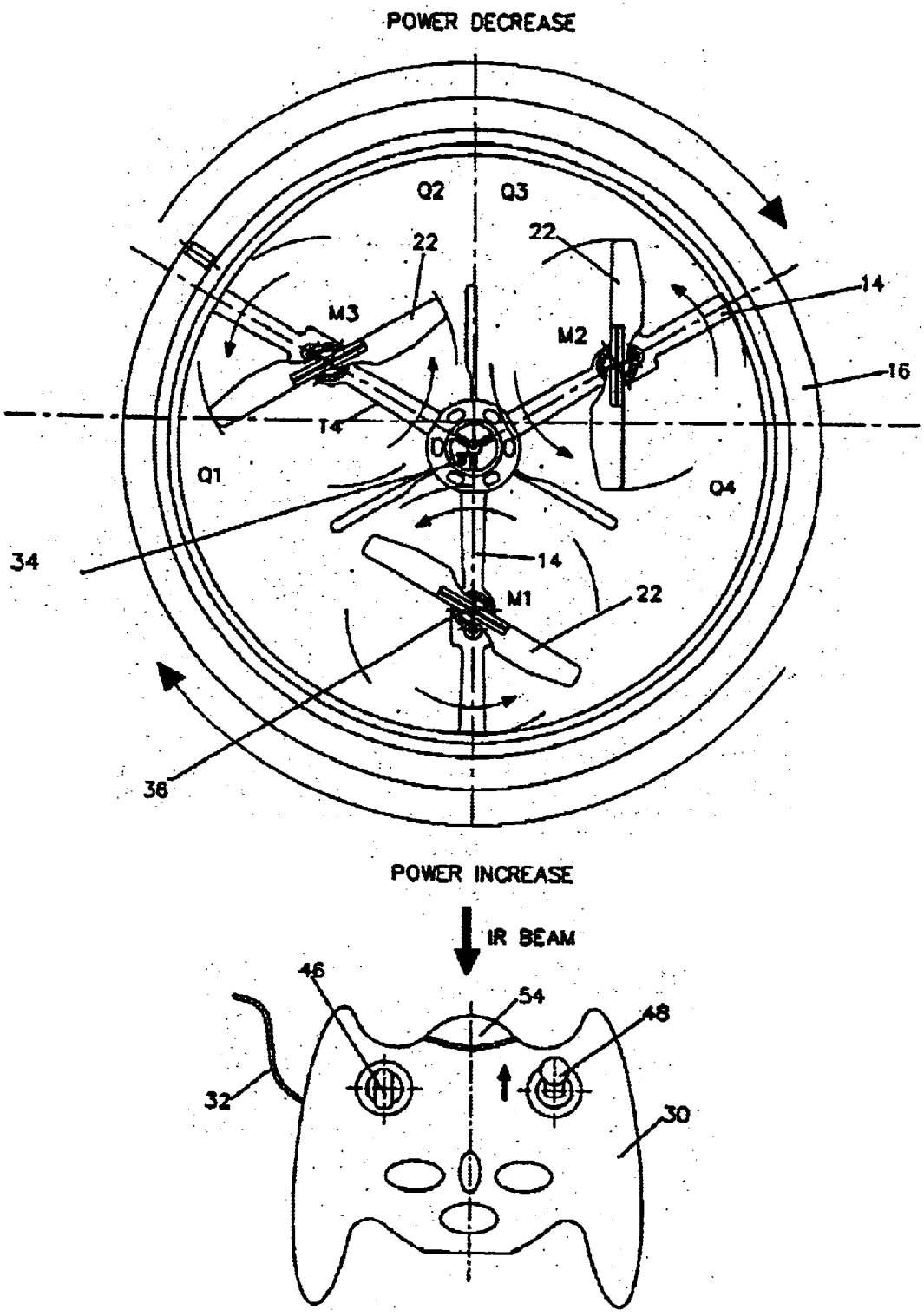
FIG. 4 is a top view of the saucer from FIG. 1, illustrating the three motors and the quadrants of the saucer in relation to the control box when the IR emitters are aligned with the IR sensor.

Referring now to FIG. 4, the saucer 10 viewed from the top portion may be divided into four quadrants, sequentially labeled Q1, Q2, Q3 and Q4, where Q1 is the back/left quadrant when viewing the saucer 10 from the top, when the IR emitters 50 and 52 are aligned with the control box 30. Following therefrom, Q2 is the top/left quadrant, Q3 is the top/right quadrant, and Q4 is the back/right quadrant. The moment the IR beam is received by the IR sensor 54, a microprocessor (not shown) in the control box 30 can determine the rotational position of the saucer 10 or orientation of the rotary devices 18 and synchronize the power distributed to the motors 20 such that the saucer 10 will fly or move in any desired direction from the perspective of the person operating the control box 30. Thereby allowing a user operating the saucer 10 to aligned themselves with the saucer 10 and direct it to the left, right, forwards or towards the user, without having the user to move about the rotating toy to direct it only in a forwards or backwards position. Since the saucer 10 is spinning at approximately 300 rpm, the IR receiver 38 typically receives the signal every ⅕ of a second, permitting a substantially constant determination of such orientation.

As mentioned above, generally the motors are referenced to as 20 but may also be referred to specifically as M1, M2 and M3, where M1 is the motor 20 that has the lower IR emitter 50 mounted thereunder, and moving in a counter-clockwise direction, M2 and M3 follow thereafter. In addition, since the preferred embodiment includes three motors 20, the radial position of each is 120° offset from one another. Similarly, if there were more rotary devices 18, the offset angle would be the total number of rotary devices divided by 360°.

The present invention further includes the ability to provide a smoother control of the power distributed to the motors 20. While in other flying or rotating toys electro mechanical commutators are used to control the power provided to each motor, the present invention generates a sine wave for each motor that is out of phase with each other by the aforementioned offset angle. Moreover, the sine waves are constructed using a number of samples to create a single cycle of each sine wave, wherein the mechanical commutators use segments in a commutator ring to control the power; where each segment would correspond to a sample. In the preferred embodiment of the present invention the sine waves are constructed from approximately 32 samples, of which it would be extremely difficult to manufacture a commutator with 32 segments. As such the present invention allows for a smoother cyclic control of the rotating toy.

During operation, a user controlling the saucer 10 may move the throttle joystick 46 and the directional joystick 48. Initially when the saucer 10 is resting on the ground, the user will move the throttle joystick 46 such that the microprocessor begins to provide and increase a drive voltage to each motor 20. The throttle joystick 46 signals to the microprocessor to control drive voltage to each motor 20 equally such that the saucer 10 raises and lowers at a level angle and not tilted to one side. If the throttle joystick 46 is pushed forward indicating an increase in throttle the microprocessor will increase the amplitude causing the motors 20 to rotate at a faster rate raising the saucer 10. Alternately, when the throttle joystick 46 is pulled back, the microprocessor will decrease the amplitude causing the rotation of the motors 20 to decrease thereby lowering the saucer 10.

Another aspect of the present invention is that the microprocessor determines the degree in which the user moves the joysticks, for example, by moving a joystick slightly forward the amplitude of the drive voltage is increased slightly, and when the throttle joystick 46 is moved forwards "all the way" the amplitude of the drive voltage is increased greater than previously causing the saucer 10 to move faster. Thus, when the throttle joystick 46 is moved the magnitude of the drive voltage is increased or decreased at a proportional rate. This aspect is the same for moving either joystick in any direction.

When the user desires to move the saucer 10 is a specific direction, the user may move the directional joystick 48. The microprocessor receiving a signal from the directional joystick 48 will generate sine waves for each motor M1, M2 and M3. The sine waves will be added to the drive voltage causing the motors to increase and decrease the power in accordance to the positive and negative peaks of the sine waves. It is important to note that the sine waves are also out of phase with one another as determined by the offset angle. However, by shifting the beginning phase angle of each sine wave, the motors can be controlled in moving the toy in a specified direction. As such, in each instance, the microprocessor shifts the three individual sine waves to the correct beginning phase angle and adds the correct amplitude to the corresponding drive voltage of each motor to direct the saucer 10 in the direction and rate determined by the directional joystick 48. By adjusting both the amplitude and the beginning phase angle of the sine waves, the user can adjust the rate in which the saucer 10 moves in a direction, as mentioned in reference to the throttle controls.

Figure 5B:
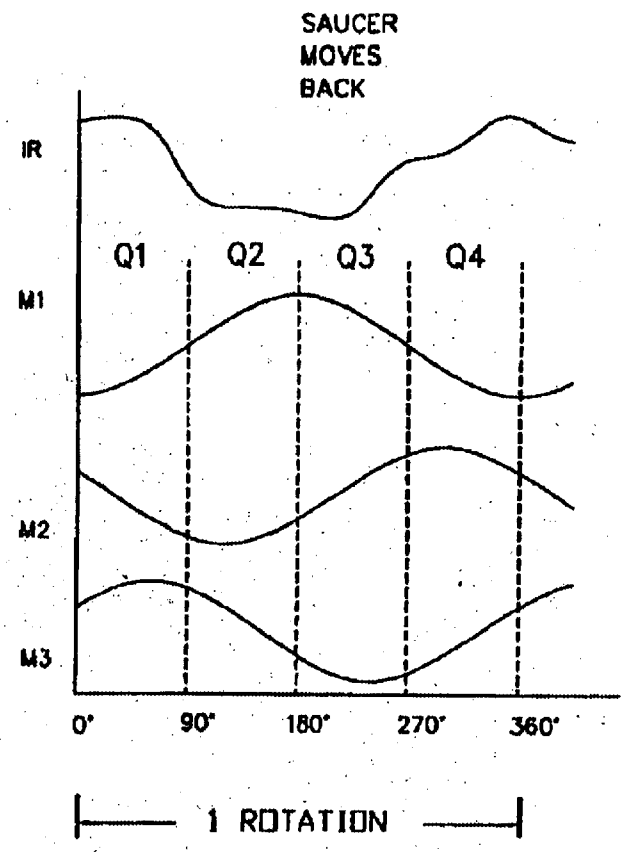
FIGS. 5*a*–5*d* illustrate the sinusoidal waves generated by the microprocessor in order to move the saucer in a direction specified by the cyclic or directional joystick on the control box.
Figure 5A:
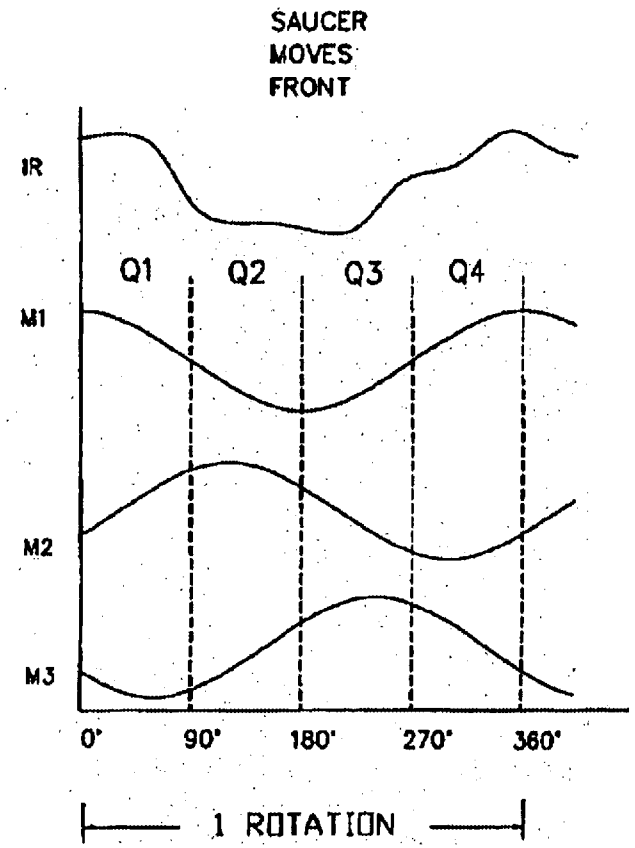
Figure 5D:
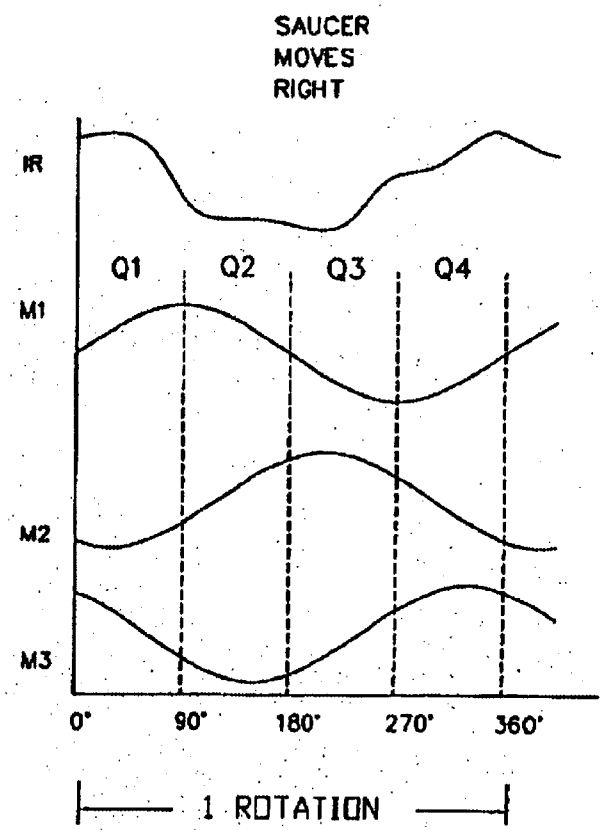
Figure 5C:
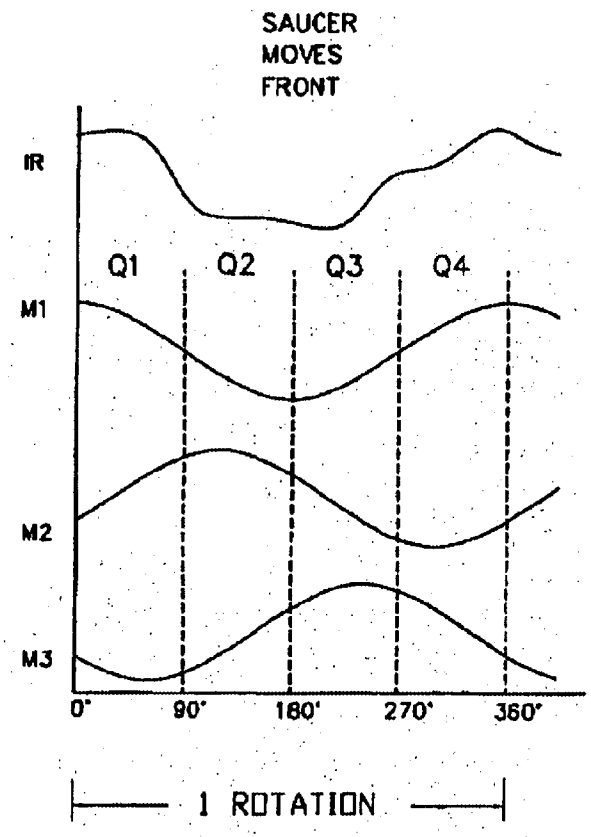

In reference to the directional control inputs to the saucer 10, FIGS. 5*a* through 5*d* illustrate the sine waves generated by the microprocessor for each motor M1, M2 and M3 for a single 360° rotation of the saucer 10. Referring to FIG. 5*a*, at 0° (when the IR emitters 50, 52 are aligned with the IR sensor 54) M1 will have a sine wave for a single cycle (360°) that has a maximum peak value at 0° and a minimum peak value at 180°; M2 being 120° out of phase with Ml will not reach a maximum peak value until it travels 120°; and M3 being 120° out of phase with M2 will not reach a maximum peak value until it travels 240°. The three sine waves added to the drive voltage will be such that the propeller 22 will rotate faster in Q1 and Q4 than in Q2 and Q3, thereby moving the saucer forwards. Referring to FIGS. 5*b* through 5*d*, the relative sine waves for M1, M2 and M3 and how the waves are synchronized with one another based up the direction of the directional joystick 48 is illustrated. In FIG. 5*b*, when the resultant thrust vector is greater in Q2 and Q3 than in Q1 and Q4, the saucer moves backwards towards the user. In FIG. 5*c*, when the resultant thrust vector is greater in Q3 and Q4 than in Q1 and Q2, the saucer moves to the left. And in FIG. 5*d*, when the resultant thrust vector is greater in Q1 and Q2 than in Q3 and Q4, the saucer moves to the right Also illustrated in FIGS. 5*a* through 5*d* is a probably IR signal received by the IR sensor 54. Since the saucer 10 may be flown indoors, the IR beam may be reflected from various objects. While the IR signal will also be generally sinusoidal with peaks corresponding to when the IR emitters 50, 52 are aligned with the IR sensor 54, false peaks smaller than the main peak may arise from IR reflections. The microprocessor must ignore or eliminate these false peaks by weighing the amplitude of the false peaks against the main peak and weighing the time of reception of the false peaks relative to when the main peak is expected. Moreover, the history of the amplitude may be tracked such that weighing of the peaks may be referred to an amplitude history.

Figure 6A:
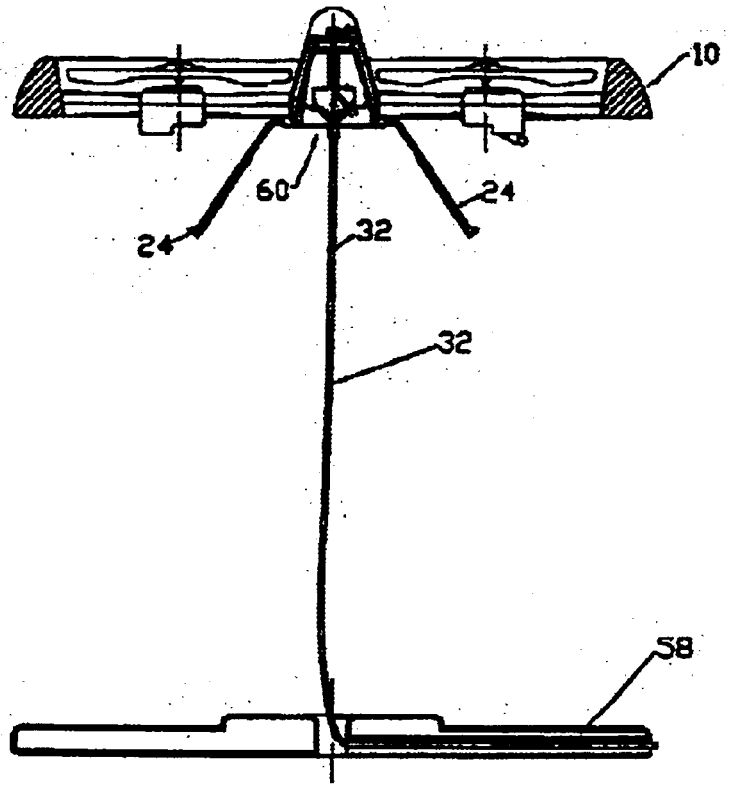
FIG. 6*a* is a side view of the saucer including a declinator and base unit.
Figure 6C:
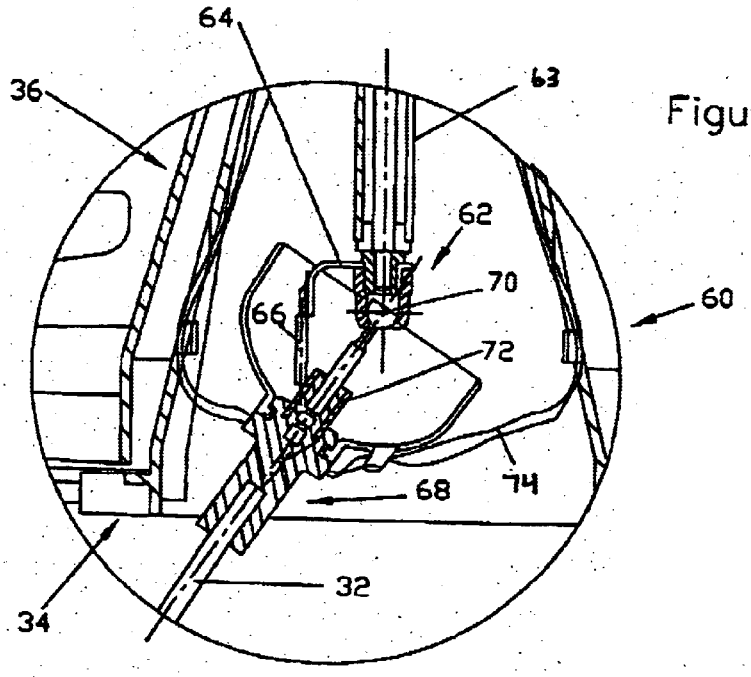
FIG. 6*c* is an enlarged view of the declinator when the saucer has moved off center as shown in FIG. 6*b;*
Figure 6B:
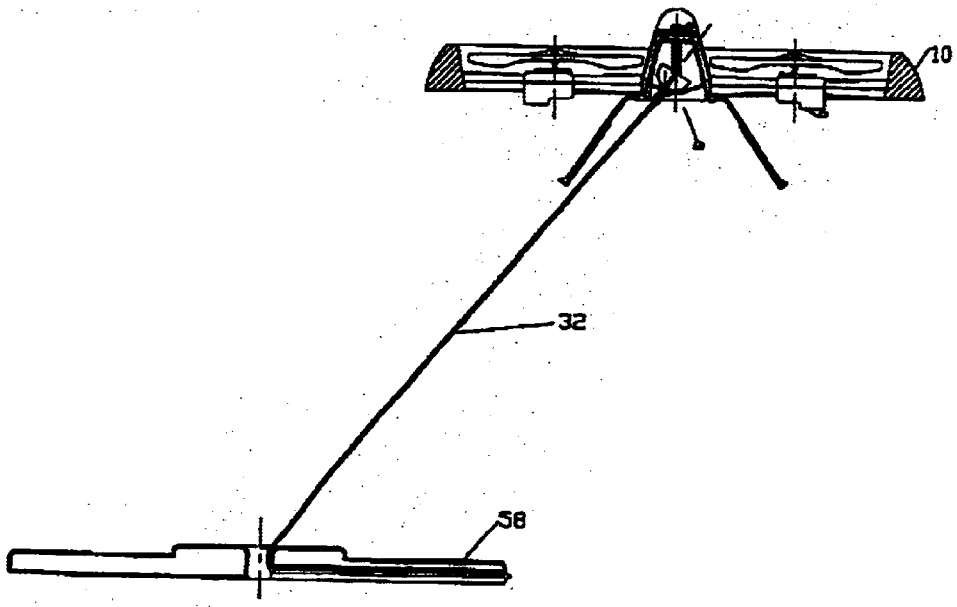
FIG. 6*b* is a side view of the saucer from FIG. 6*a* when the saucer has moved off from its center position above the base unit.

Referring now to FIGS. 6*a*–6*c*, in another aspect of the present invention the saucer 10 includes a training mode which helps maintain the saucer 10 flying relatively above a center position. Illustrated in FIG. 6*a*, the saucer 10 is shown with its tether 32 connected to a base unit 58 positioned on the ground. The base unit 58 will limit the height in which the saucer 10 will be able to fly, as such the saucer 10 will have a spherical flying path defined by the length of the tether 32 that extends out from the base unit 58. To keep the saucer 10 flying relatively about the center position or over the base unit 58, the tether 32 connects to the non-rotating portion of the saucer 10 through a declinator 60. When the declinator 60 senses that the angle between the tether 32 and the non-rotating portion is greater than a predetermined angle, the declinator 60 sends a signal through the tether 32 to the microprocessor indicating that the saucer 10 is flying off from its center position. The microprocessor receiving this signal can then return control inputs to the motors 20 directing the saucer 10 back towards the center position.

More specifically, the declinator 60 includes an upper assembly 62 that is connected to a shaft 63 supported by the rotating portion of the saucer 10. The assembly 62 has an arm 64 extending therefrom that further supports a spring 66. The tether 32 is attached to a lower assembly 68 that is connected to the upper assembly 62 by a swivel 70 that permits the upper assembly 62 to rotate and the lower assembly 68 to remain substantially non-rotating. The lower assembly 68 further includes a conductive ring 72. When the saucer 10 moves to a position away from the center, the tether 32 will move the lower assembly 68 at an angle from the upper assembly 62. At a predetermined angle, the spring 66 will come into contact with the conductive ring 72. A signal is thereafter generated by the contact and sent through the tether to the microprocessor. The time that the spring 66 touches the conductive ring 72 is compared to the rotational cycle in order to calculate the direction in which the saucer 10 has moved. The microprocessor may then send a corrective signal (in form with the sine waves for each motor, as discussed above) to deflect the saucer towards the center position, above the base unit. Wires 74 extending from the lower assembly 68 communicate the signals from the microprocessor to the circuit board 40 (not shown).

Figure 7B:
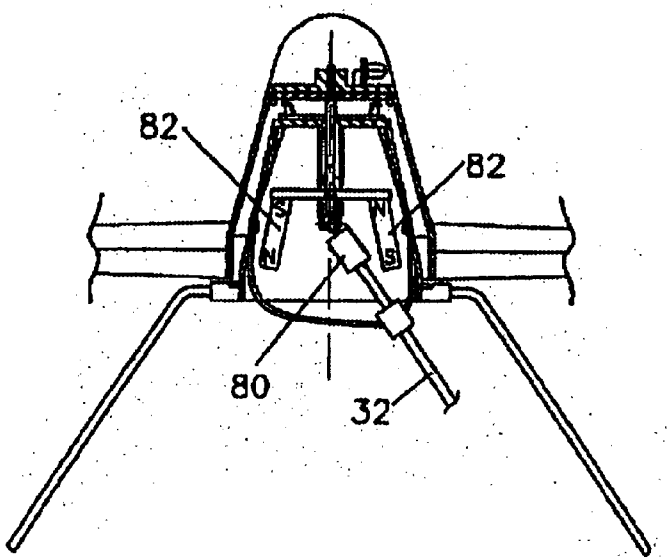
FIGS. 7*a* and 7*b* illustrate another embodiment of the saucer incorporating a hall effect sensor and a pair of magnets in creating a feedback system.
Figure 7A:
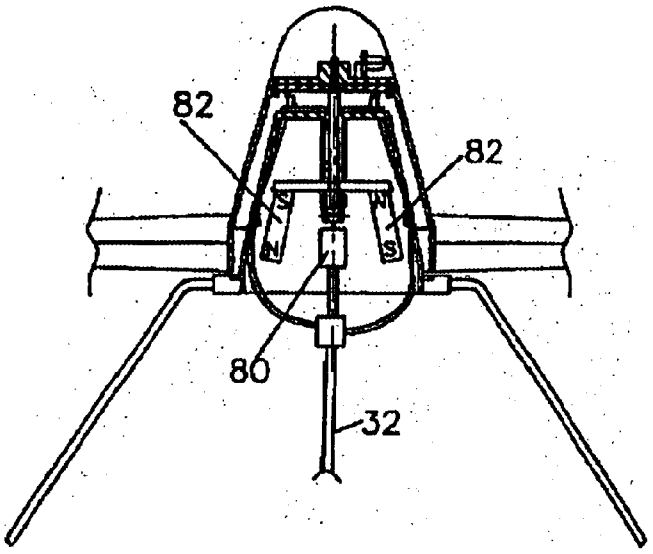

Other forms of feedback systems that are continuous (or analog) in nature could also be used, such as a hall effect sensor with a rotating magnetic field, or a strain sensor to detect the magnitude and direction of the tether deflections. Referring now to FIGS. 7*a* and 7*b*, a hall effect sensor 80 is positioned on the lower assembly 68 and a pair of reverse rotating magnets 82 are positioned on the upper assembly 62. The magnets 82 are arranged such that there is a magnetic null in the center, where the hall effect sensor 80 is located. When the hall effect sensor 80 moves towards one of the magnets 82, the magnetic field increases towards that magnet and an increasing but opposite field towards the other magnet. A hall effect sensor 80 creates and sends a sinusoidal signal to the microprocessor. The amplitude of the signal is determined by the amount of deflection and the phase is determined by the direction of the deflection. The microprocessor receives the signal and creates sine waves for the motor, as discussed above, deflecting the saucer 10 towards the center or the magnetic null.

It is noted that any other form of directional signal could be used, i.e. visible light, radio waves, magnetic field or sound. Moreover, the direction could further be reversed such that the emitter is on the control box and the sensor on the flying saucer. In a reverse direction, the control information could be transmitted with the reference signal and if an onboard power source were included in the rotating toy, the model could be free flying, meaning without a tether 32 or controlled through wireless means.

Figure 8:
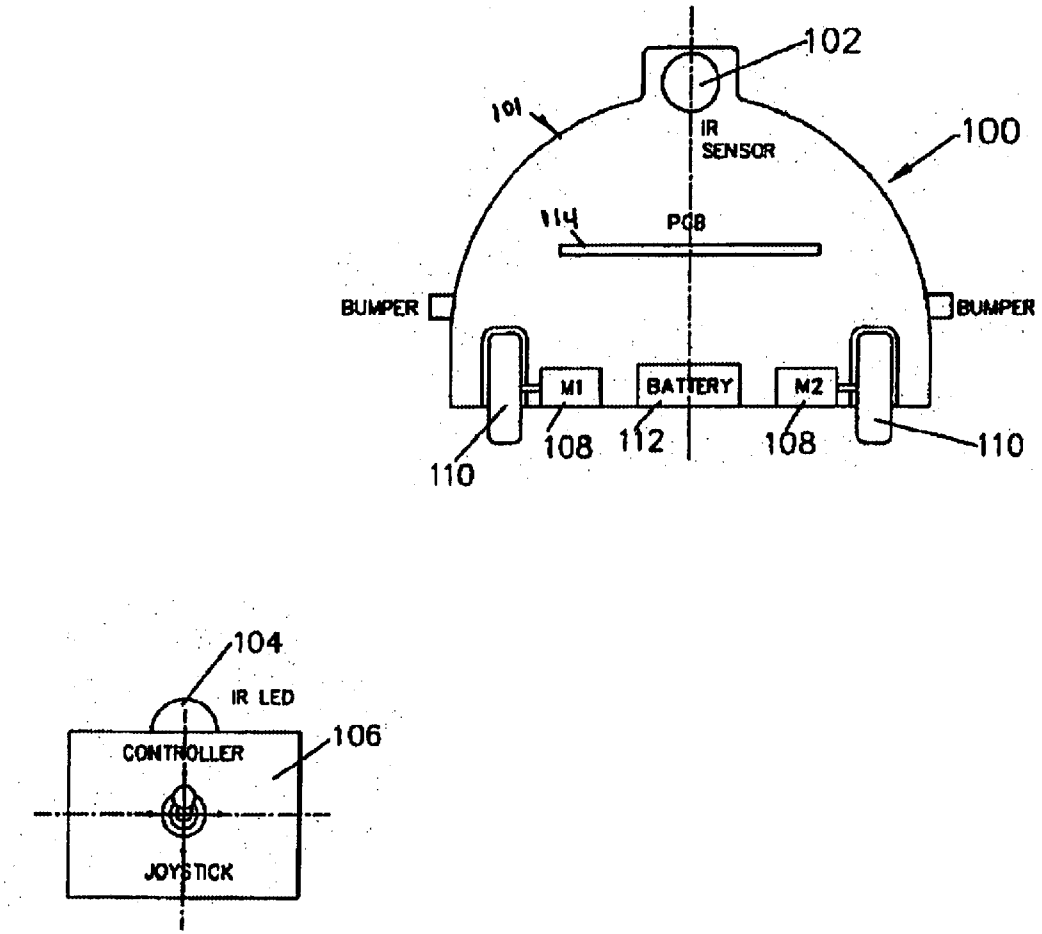
FIG. 8 is a side view of another embodiment of a ground based rotating toy implementing the IR control system that was described in the previous embodiments.

The aforementioned means in controlling the direction of a rotating toy may further be applied to other embodiments of rotating toys. For example and illustrated in FIG. 8 the rotating toy may be a robot 100. The robot 100 has a central body portion 101 that houses the components. The robot 100 includes an IR sensor 102 positioned on the top portion thereof, configured to receive a signal from an IR transmitter 104 located on a control box 106. The directionality of the IR beam is provided by a restricted view angle of the sensor 102. The robot 100 further includes two motors 108 operably connected to a wheel 110 such that when powered the wheels 110 rotate the robot 100 in a predetermined direction. The robot 100 also has a power source or battery pack 112. The control box 104 emits a direction code corresponding to the directional inputs from the control box 106. Upon reception by the robot 100, a microprocessor 114 on the robot 100 can decode the signal and create cyclic control signals that are out of phase from each other by 180° (since there is two motors 108 the phase is determined from the number of motors 108 divided by 360°). The two sine waves would be added to the two motor drive voltages, such that the robot 100 would travel in a direction corresponding to the inputs from the control box 106, in a manner similar discussed above.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

What is claimed is:

1. A rotating toy comprising:

a hub having an outer portion rotatably connected to an inner portion;

at least three rods extending outwardly from the outer portion and connecting to at least one outer ring, the rods further being positioned at a predetermined offset angle from each other;

a rotary device disposed on each rod between the hub and the outer ring, each rotary device includes a motor and a propeller, the propellers being designed to generate lift when rotating by displacing air downwardly, and when the propellers are rotating the motors may generate a reaction torque causing the outer portion of the hub to rotate defining a rotating portion which includes the outer portion of the hub, the rods, the rotary devices and the outer ring;

a plurality of legs extending downwardly from the inner portion of the hub to support the rotating toy in an upright configuration when the rotating toy is positioned on a surface, each leg includes a vane protruding outwardly into downwardly displaced air to deflect said displaced air such that the vanes tend to drive the inner portion of the hub in a direction opposite of the outer portion such that when the outer portion is rotating the inner portion is substantially non-rotating defining a non-rotating portion;

a means for determining a directional point of reference for the motors when said toy is rotating; and a means for individually controlling the speed of the motors such that the rotating toy may travel in a specified direction.

2. The toy of claim 1, wherein the directional point of reference determining means comprises:

a pair of IR emitters oppositely positioned on the top portion and the bottom portion of the rotating portion of the toy, the pair of IR emitters being further positioned such that the IR emitters cast IR beams outwardly along the same radial axis; and an IR receiver being placed remotely from the rotating toy and in communication with the controlling means such that upon sensing the IR beam the controlling means may determine the directional point of reference of the three motors.

3. The toy of claim 2, wherein the controlling means includes a control box in communication with the rotary devices through a tether that is attached from said control box to the inner portion of the hub.

4. The toy of claim 3 further comprising a means to remotely supply a drive voltage through the tether to each motor.

5. The toy of claim 4, wherein the control box further includes:

a microprocessor in communication with each motor;

a throttle controller in communication with the microprocessor such that the throttle controller may indicate to the microprocessor to increase and decrease the drive voltage to each motor; and a directional controller in communication with the microprocessor such that the directional controller may indicate to the microprocessor to generate and add a predetermined sinusoidal wave to each drive voltage corresponding to a specified direction, wherein the predetermined sinusoidal waves may cause the toy to have a resultant thrust vector in said specified direction.

6. The toy of claim 5, wherein each predetermined sinusoidal wave is out of phase with one another by the predetermined offset angle.

7. The toy of claim 5, wherein each predetermined sinusoidal wave has a beginning phase shift angle determined upon the specified direction.

8. The toy of claim 5 further includes a means for sensing when an angle of declination between the tether and the hub is at least a predetermined angle, the sensing means further providing a signal to the microprocessor such that the microprocessor upon receiving said signal may adjust the sinusoidal waves of the motors to move the rotating toy in a direction such that said declination angle becomes less that said predetermined angle.

9. The toy of claim 8, wherein the sensing means includes:

an upper assembly attached to the rotating portion of the hub, the upper assembly having an arm extending outwardly and a spring attached to said arm;

a lower assembly in communication with the tether and attached to the upper assembly by a swivel such that upper assembly may rotate with the rotating portion and the lower assembly may pivot about the swivel; and a conductive ring positioned about the lower assembly such that when the tether pivots the lower assembly by at least a predetermined angle defined between the lower assembly and the spring, the conductive ring contacts the spring sending a signal through the tether to the microprocessor, wherein the microprocessor receiving said signal can determine the orientation of the three motors when said conductive ring contacted the spring and adjust the sinusoidal waves of the motors to move the rotating toy in a direction such that the lower assembly pivots said declination angle becomes less said predetermined angle.

10. The toy of claim 5, further including a feed back system such that when the toy moves from a center position to an off center position, the microprocessor may adjust the motors proportionally to the amount the toy has moved from the center position such that the toy has a tendency to return to the center position.

11. The toy of claim 10, wherein the feed back system includes:

an upper assembly all ached to the rotating portion of the hub;

a lower assembly in communication with the tether and attached to the upper assembly by a swivel such that upper assembly may rotate with the rotating portion and the lower assembly may pivot about the swivel;

a plurality of magnets positioned about the lower assembly and attached to the rotating portion of the hub creating a magnetic null in the center substantially about the lower assembly; and a hall effect sensor attached to the lower assembly and in communication with the microprocessor such that when the tether pivots the lower assembly the hall effect sensor will generate a sinusoidal wave having an amplitude defined as an amount of deflection the hall effect sensor has moved away from the magnetic null and the phase is defined as a direction of the deflection, wherein the microprocessor receiving the signal can adjust the motors to move the rotating toy in a direction opposite of said deflection such that the hall effect sensor is moved towards the magnetic null.

12. The toy of claim 8 further comprising:

a base unit having an aperture for receiving a portion of the tether and being positioned on the ground such that the rotating toy is restricted to a flying radius defined by the length of the tether between the base unit and the rotating toy.

13. The toy of claim 1, wherein the means for determining directional point of reference comprises:

an IR emitter being placed remotely from the rotating toy for transmitting an IR beam; and a pair of IR receivers positioned on the top portion and the bottom portion of the rotating portion of the toy, the pair of IR receivers are positioned along the same radial axis, and the IR receivers in communication with the controlling means such that upon sensing the IR beam the controlling means may determine the specific orientation of the three motors.

14. The toy of claim 13 further comprising:

a means to supply power separately to each motor secured on the rotating toy;

a microprocessor in communication with each power supply means and each motor.

15. The toy of claim 14 further comprising:

throttle controls means in wireless communication wit the microprocessor, the throttle controls means for sending a signal to the microprocessor indicating an increase and decrease an amount of power separately supplied to each motor equally; and directional controls means in wireless communication with the microprocessor, the directional control means for sending a signal to the microprocessor indicating a direction and a rate in which the toy is to move, wherein the microprocessor receiving said signal may generate and add a sinusoidal wave to each separately supplied power, wherein each sinusoidal wave is offset from each other by the predetermined offset angle and each sinusoidal wave further has a predetermined beginning phase angle such that the motors have a resultant thrust vector in said direction and each sinusoidal wave has an amplitude corresponding to said rate.

16. The toy of claim 15, further including a feed back system such that when the toy moves from a center position to an off center position, the microprocessor may adjust the separately supplied power to the motors proportionally to the amount the toy has moved from the center position such that the toy has a tendency to return to the center position.

17. The toy of claim 1, wherein each propellers similarly inclined approximately 40°, such that when the rotary devices are operating, the rotating propellers cause the rotating portion to rotate in the opposite direction of the rotating propellers.

18. The toy of claim 3, wherein the communication between the tether and rotary devices includes:

a circuit board secured to the rotating portion of the hub;

four rings mounted on the circuit board; and four spring loaded brushes mounted on the non-rotating portion of the hub and in communication with control box and the circuit board, each brush corresponding to one of the rings, wherein three of the rings and corresponding brushes are individually in communication with one of the motors and the other ring and corresponding brush is common to the other rings and corresponding brushes.

19. The rotating toy of claim 1, wherein the outer portion is rotatably connected to the inner portion by a substantially frictionless bearing.

20. A rotating toy comprising:

a hub supporting a plurality of motors positioned at a predetermined offset angle from each other, the motors secured to a means for rotating the toy and wherein the motors include a propeller operably connected thereto and orientated such that when the propellers are rotating the rotating toy may lift off the ground;

a means to provide a drive voltage to each motor;

a means to determine the orientation of the motors from a point of reference in a remote non-rotating control box;

a means to generate and add a sinusoidal wave to each drive voltage, wherein each sinusoidal wave is out of phase with each other by the predetermined offset angle;

a means to control the amplitude and to shift a beginning phase angle of each sinusoidal wave in response to speed and directional inputs from the remote non-rotating control box, such that the rotating toy may move in a direction referenced from the non-rotating body in response to said speed and directional inputs;

the hub being further defined as having an outer portion rotatably connected to an inner portion;

the outer portion supports a plurality of rods extending outwardly therefrom substantially along the seine plane, the rods further support an outer ring, and each rod supports one of the motors between the outer ring and the outer portion;

the inner portion supports a plurality of legs extending downwardly therefrom to support the rotating toy in an upright configuration when is positioned on a surface, each leg includes a vane protruding outwardly such that the air downwardly displaced by the propellers lifting the rotating toy off the ground is deflected, driving the inner portion of the hub in a direction opposite of the outer portion such that when the outer portion is rotating the inner portion is substantially a non-rotating portion; and the inner portion further supports a tether attached to the inner portion of the hub and to the remote control box, the tether is in communication with the motors and the control means.

21. The rotating toy of claim 20, further including a feed back system such that when the rotating toy moves from a center position to an off center position, the control means may adjust the motors proportionally to the amount the rotating toy has moved from the center position such that the rotating toy has a tendency to return to the center position.

22. The rotating toy of claim 21, wherein the remote control box includes the means to provide the drive voltage to each motor and the means to control the amplitude and the beginning phase angle of each sinusoidal wave.

23. The rotating toy of claim 22, wherein the means to determine the orientation of the motors from a point of reference in the remote control box includes mounting a pair of IR emitters on the rotating toy in a predetermined position relating to a specific orientation of the motors, the IR emitters are mounted such that the IR transmitters rotate along with the motors and transmit an IR beam along the same radial axis, and further mounting an IR sensor on the remote control box such that when the IR beam is received by the IR sensor, said specific orientation of the motors is determined.

* * * * *